United States Patent [19]

Jones

[11] Patent Number: 4,580,626

[45] Date of Patent: Apr. 8, 1986

[54] BLOWOUT PREVENTERS HAVING SHEAR RAMS

[75] Inventor: Marvin R. Jones, Houston, Tex.

[73] Assignee: Koomey Blowout Preventers, Inc., Brookshire, Tex.

[21] Appl. No.: 669,059

[22] Filed: Nov. 7, 1984

Related U.S. Application Data

[63] Continuation of Ser. No. 446,390, Dec. 2, 1982, abandoned.

[51] Int. Cl.[4] ..... E21B 29/08

[52] U.S. Cl. ..... 166/55; 92/65

[58] Field of Search ..... 166/55, 55.1, 297, 298, 166/361; 251/1 R; 92/62, 63, 65

[56] References Cited

U.S. PATENT DOCUMENTS

| | | | |
|---|---|---|---|
| 787,479 | 4/1905 | Tanner | 92/65 |
| 3,946,806 | 3/1976 | Meynier, III | 166/55 |
| 4,132,266 | 1/1979 | Randall | 166/55 |

*Primary Examiner*—Stephen J. Novosad
*Assistant Examiner*—Thuy M. Bui
*Attorney, Agent, or Firm*—Vaden, Eickenroht, Thompson, Jamison

[57] ABSTRACT

There is disclosed a blowout preventer having rams with cutting edges for shearing a pipe within the vertical bore through the preventer housing which rams carry means for gripping opposite sides of the pipe above the cutting edges of the rams, as the rams move toward one another to shear the pipe, and lifting the upper sheared end of the gripped pipe out of the path of means for sealing between the inner ends of the rams, as the rams continue to move toward one another.

24 Claims, 9 Drawing Figures

BLOWOUT PREVENTERS HAVING SHEAR RAMS

This application is a continuation of application Ser. No. 446,390, filed Dec. 2, 1982, now abandoned.

This invention relates generally to valves such as ram type blowout preventers used in the drilling and completion of oil and gas wells.

In one of its aspects, this invention relates to improvements in blowout preventers of this type which are adapted to be mounted on a wellhead and whose rams are adapted to shear a pipe such as a drill string within the bore of the housing of the preventer, as they move inwardly from open position and then, upon continued inward movement and shearing of the pipe, to seal with respect to one another and with respect to guideways in the housing of the preventer in which the rams move in order to close the bore. Thus, the upper sheared end of the drill string may be pulled from the well bore when it becomes desirable to move the drilling rig away from the well in a short time.

In another of its aspects, it relates to improvements in valves, and especially blowout preventers, in which the closure member or members, or rams of the preventer, are moved between opened and closed positions by a fluid-operated system having pistons connected to them by means of the rods extending from the cylinders of the system into chambers in the housing on the outer ends of the closure members/or rams, whereby fluid within the chamber acts over the cross sectional area of the rod to provide a force which opposes closing movement of the closure members or rams. In still another of its aspects, it relates to improvements in valves, and especially blowout preventers, of this type in which a bypass groove connects the bore of the valve body or preventer housing with the chamber behind each member or ram so as to provide a force which supplements that of the operating system to maintain the member or ram closed.

As shown, for example, in the blowout preventers of U.S. Pat. Nos. 2,919,111 and 2,969,838, the pipe is flattened and then sheared by means of cutting edges on the inner ends of the rams which move closely past one another, and seal means including a packing is carried by each ram face for engaging a packing on the other ram at a level spaced vertically of the cutting edges. In the preventer of a subsequent U.S. Pat. No. 3,561,526, a packing on each ram face above or below the cutting edge thereof is positioned to be engaged by a surface on the inner end of the other ram adjacent its cutting edges. When the bore of the preventer is empty, the rams merely function as "blind" rams to close off the open bore.

In using any of these preventers, however, it was necessary, after moving them inwardly to shear the pipe, to retract the rams to permit the upper sheared end of the pipe to be lifted from the path between the face seals, and then, with the pipe so removed, move the rams inwardly to the fully closed position. In the preventer of U.S. Pat. No. 3,561,526, it was also necessary to move or drop the lower end of the sheared pipe in order to close the rams. However, in a modification of the preventer of U.S. Pat. No. 2,969,838, the lower sheared end of the pipe was adapted to be received in a recess so that it was necessary to remove only the upper sheared end thereof.

It was the purpose of the preventers of U.S. Pat. Nos. 3,817,326 and 3,736,982 to simplify this procedure by providing rams adapted to shear and then seal to close the bore upon continuous forward movement of the rams—i.e., without having to first retract them. Thus, the sealing means of the rams included a packing carried by a horizontal surface extending rearwardly from the cutting edge of one ram to seal with a confronting surface extending rearwardly from the cutting edge of the other blade, and thus along the plane of shear, upon movement of the surfaces across one another following shearing. The sheared ends of the pipe were received in recesses formed in each ram outwardly of the cutting edges and thus out of the way of the shearing operation.

However, difficulty in holding the confronting surfaces sufficiently close together in order to maintain the packing between them, together with the inherently small packing areas responsive to ram closing force, led some to return to shear rams having transverse face packings. One such approach is shown in U.S. Pat. No. 4,132,265 wherein the inner end of one ram is tapered upwardly and outwardly to cooperate with a shoulder on the inner end of the other ram above a face packing thereon for wedging the upper cut end of the pipe upwardly out of the way of the path between the inner end of the one ram and the packing. One obvious drawback of a preventer of this latter construction is the frictional resistance to sliding of the cut end of the pipe over the tapered inner end of the one ram. Also, when the angle between this tapered end and the vertical is relatively large in order to increase the mechanical advantage of the wedge, the end becomes so thin that it is susceptible to failure due to the load of the pipe end above it.

It is therefore an object of this invention to provide a blowout preventer in which the cut end of the pipe is removed from the path between the sealing faces of the rams merely in response to continuous inward movement of the rams to shear the pipe and close the bore, but without having to wedge the upper cut end of the pipe to an out-of-the-way position, as, for example, in the preventer of U.S. Pat. No. 4,132,265.

The force required to shear a pipe within a blowout preventer is considerably greater than that required to cause the ram packing to seal between the rams and between the rams and the preventer guideways. Hence, in preventers of this type having conventional fluid-operated systems for moving the rams, this force may develop excessive pressures in the packing, and, in any event, considerably more pressure than that needed to insure an adequate sealing engagement of the ram packings with cooperating surfaces on rams and guideways.

It is therefore another object of this invention to provide a blowout preventer in which the shear rams are moved to be closed position, following shearing of the pipe, with a force not substantially greater than that required to seal between them and between them and the preventer guideways; and, more particularly, to provide such a preventer with a relatively simple and compact fluid-actuated operating system capable of moving the shear rams inwardly to shear the pipe with a first, relatively large force, and then continue to move them further inwardly to seal with respect to one another and with respect to the guideways with a second, relatively small force.

In preventers of this type, a means is conventionally provided to connect the bore beneath the closed rams with chambers behind them, whereby, with the rams closed, well fluid pressure acts over at least part of the area on the outer ends of the rams to provide a force which supplements hydraulic operating pressure in maintaining the ram packings in sealing engagement. For this purpose, grooves may be provided in the lower sides of the rams so as to maintain the bore and chamber connected to one another. In an effort to reduce the size of the operating system necessary to provide an opening force for overcoming this supplemental force due to well fluid, U.S. Pat. No. 3,036,807 proposed a preventer having rams with valve-controlled passageways for connecting the bore with the chambers when the rams were closed, and then connecting the chamber with the bore above the closed rams (which ordinarily is at a much lower pressure than the bore beneath them), and thereby substantially balancing pressure across the ends of the rams, in response to outward, opening movement of the rams. In the preventer shown in my copending patent application, Ser. No. 337,383, filed Jan. 6, 1982, and entitled "Hydraulically Operated Valves", grooves are formed in the lower sides of the rams, and flow through a passageway for connecting the chamber with the bore above each of the closed rams is controlled by a valve head on the end of the rod connecting with a piston in the cylinder of the operating system and having a lost motion connection with the ram as to close the outer end of each passageway as the ram moves inwardly with the piston rod and open such outer end as the ram moves outwardly with the piston rod.

Although the preventer of both U.S. Pat. No. 3,036,807 and my copending application accomplish the desired result of reducing the force required to withdraw the rams, the rams of such patent, and, to a lesser extent, the rams of my application are of complicated construction which increases the overall expense of the preventer. It is therefore a further object of the present invention to provide a preventer in which basically the same purpose may be accomplished with less expense.

As also noted in my copending application, the operating system of the blowout preventer disclosed in U.S. Pat. No. 3,036,807 is of such construction that the force due to well fluid and acting over the piston rod entering the ram chamber to oppose movement of the rams to closed position is substantially reduced or even eliminated. Thus, a rod extends from the outer end of the piston of the operating piston for each ram into an outer chamber of the housing, and a hole is formed through the piston and both the outer rod and the inner rod so that, with the rods being of substantially the same cross-sectional area, they are substantially balanced.

In the preventer shown in my copending patent application, grease is injected through a fitting into the outer chamber and the hole through the rods and piston, and the drilling mud and grease are separated by a plug slidable within the hole, as the outer rod moves within the outer chamber, so as to substantially exclude drilling mud within the bore of the housing from the chamber, and thus to protect seals about the outer rod into such chamber. More particularly slots are formed in the hole at the inner and outer ends of the rods to permit grease to bypass the plug when moved to an inner limited position, and to permit well fluid to bypass the plug when it is moved to an outer limited position in order to fill any voids within the outer chamber.

Although this aspect of the operating system is desirable in substantially excluding well fluid from the balance chamber, it nevertheless is a costly addition due to the requirement of machining bypass slots in the rods. Hence, it is still another object of this invention to provide a preventer and a ram operating system or similar flow controlling apparatus of the type described in which the same purposes are served with less machining costs and thus at less overall expense.

The foregoing and other objects are accomplished, in accordance with the illustrated embodiment of this invention, by a ram type blowout preventer of the type described which is similar to prior preventers in that each ram has a cutting edge on its inner end for moving across the cutting edge of the other ram in order to shear a pipe within the bore, as the rams move toward one another within their respective guideways, and means are provided for sealing between the rams above the cutting edges and between each ram and the guideway in order to close the bore, upon shearing of the pipe and continued movement of the rams toward one another. However, in accordance with one novel aspect of this invention, means are carried by the rams for gripping opposite sides of the pipe above the edges, as the rams move toward one another to shear the pipe, and lifting the upper sheared end of the gripped pipe out of the path of the means for sealing between them, as the rams continue to move toward one another. Consequently, the rams close the bore without having to wedge the upper sheared end along a tapered surface of one of the blades, and thus without the problems heretofore noted with respect to the prior art—namely, that of overcoming the frictional resistance due to sliding of the upper sheared end of the pipe over the tapered surface, and/or the possibility of damaging the tapered end of the one ram.

In the preferred embodiment of the invention, this gripping and lifting means comprises an arm mounted on each ram for pivoting about a generally horizontal axis transverse to the axis of reciprocation of the ram, and means supported each arm in such a position that its inner end moves into gripping engagement with a side of the pipe above the pivot axis thereof, whereby, upon continued inward movement of the rams, the arms tilt upwardly about such axis to lift the sheared end of the pipe with progressively larger vertical components of force. Preferably, the arms are so supported that an imaginary line extending through the pivot axis and their inner ends form an angle with respect to the horizontal which increases from about 30° in the supported position to about 60° when the rams are closed. In the absence of a pipe within the bore, the inner ends of these arms will engage with one another and thereby pivot upwardly together to the extent necessary to permit the inner ends of the "blind" rams to move into sealing engagement.

As illustrated, each ram has a recess in its upper side which is open at its front end and each arm of each ram is supported within the recess with its inner end extending through the open end thereof, the upper side of the guideway limiting movement of the top side of the ram out of the recess, as the ram is moved to closed position, and being engageable with the top side of the arm to insure return of the arm into the recess as the ram returns to open position. As also illustrated, the means for sealing between the rams includes packing on one ram above the lower cutting edge for engagement by a surface on the inner end of the other ram above the upper cutting edge, although, in accordance with the broader aspects of the present invention, other means for sealing between the rams may be provided.

In accordance with another novel aspect of the present invention, a fluid-operated means for moving the rams inwardly to shear a pipe within the bore of the preventer and then seal with respect to one another and the guideways of the housing is of such construction that it moves the rams inwardly with a first force to shear the pipe, and with a second, smaller force, to close the bore, whereby the sealing means of the rams is not excessively pressurized. In the illustrated embodiment of the invention, the second force is also effective to cause the arms on the rams to lift the upper sheared end of the pipe above the sealing means on the inner ends of the rams as the rams move to closed position.

In its illustrated and preferred embodiment, the operating means includes first and second pistons sealably reciprocable within each cylinder, and means for selectively supplying control fluid to or exhausting control fluid from opposite sides of the pistons within the cylinders to either urge them toward or away from the housing bore. More particularly, a rod connects each ram to one of the pistons for inward and outward movement with it, and the other piston within the cylinder has limited inward and outward movement with respect to the one piston, so that it is engageable with the one piston in response to the supply of control fluid to the outer sides of the piston to urge the rams inward to shear the pipe with a first force due to such fluid acting over both pistons. However, a means is provided within each cylinder for stopping inward movement of the other piston when the rams have been moved inwardly to shear the pipe, whereby the one piston is free to continue to move inwardly to close the rams. Thus, the rams are moved inwardly to seal with one another and their guideways, and, in the illustrated embodiment of the invention, to lift the upper cut end of the pipe, with a relatively small force due to control fluid acting over only the one piston. As illustrated, the first such piston is sealably slidable within the cylinder, and the second piston is sealably slidable within the first piston. More particularly, in the illustrated embodiment, the first piston is the other piston, and the second piston is the one piston.

The preventer of the present invention, is similar to that shown and described in my copending application in that a force due to well fluid is effective over at least part of the outer end of the ram within the chamber behind it to assist the force of the operating system in holding the sealing means on the rams in tight sealing engagement with one another and their guideways, as well as in lifting the upper cut end of the pipe. Additionally, means are provided for venting well fluid from the chamber to the bore above the closed rams in order to reduce the forces acting on the rams in response to inward movement of the ram connecting rod, but prior to opening movement of the rams, so as to facilitate withdrawal of the rams from a closed position. However, in accordance with the present invention, this is accomplished by a modification of only one rather than both of the rams. That is, a passageway is provided in only one of the rams for connecting the chamber behind it with the bore of the housing above the closed rams, and the other ram may be of more conventional construction. Thus, when the one ram opens and moves away from sealing engagement with the other ram, the pressure drop across the rams decays, the operating system for the other ram is able to withdraw it without having to overcome the force due to well fluid acting over at least part of the outer end of the other ram to maintain it in its closed position.

The preventer of the present invention is also similar to that of my copending application in that the connecting rod of the operating piston to at least one of the rams is essentially pressure balanced so that the operating means need not overcome the force of line fluid acting over the cross-sectional area of the rod to resist its opening movement. Thus, as above described, there is another rod on the other end of the operating piston for that ram which extends sealably into a chamber in the preventer housing outwardly of the operating cylinder, and a hole extends through the piston and both of the rods to onnect the bore of the housing with the outer balance chamber a plug is slidably mounted within the hole for separating drilling mud in the bore from grease which is injected into the outer chamber and the hole outwardly of the plug by means of a fitting carried by the housing. According to the present invention, however, the plug has restricted port means through it to permit grease to bypass the plug when the plug is in its inner position and to permit well fluid to bypass the plug when the plug is in its outer position. A plug of this construction is of course simple and inexpensive to fabricate, as compared with the cost of machining slots at the inner and outer ends of the hole through the inner and outer rods of the operating means of the preventer of my copending application.

In the drawings, wherein like reference characters are used throughout to designate like parts:

Figure 6:
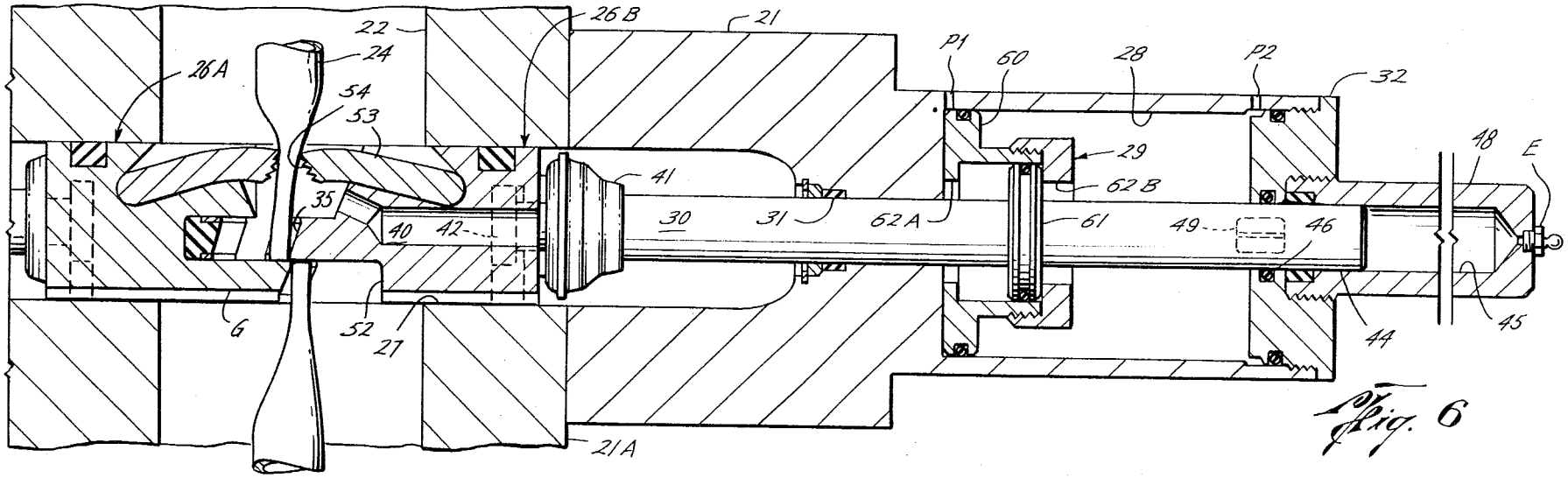
FIG. 6 is view similar to FIG. 5, but upon further inward movement of the rams cause the blades to shear the pipe and the inner ends of the gripping and lifting arms to grip and flatten opposite sides of the pipe above the cutting blades of the rams, and showing the outer annular piston of the operating system moved into abutment with the inner end of the cylinder.
Figure 7:
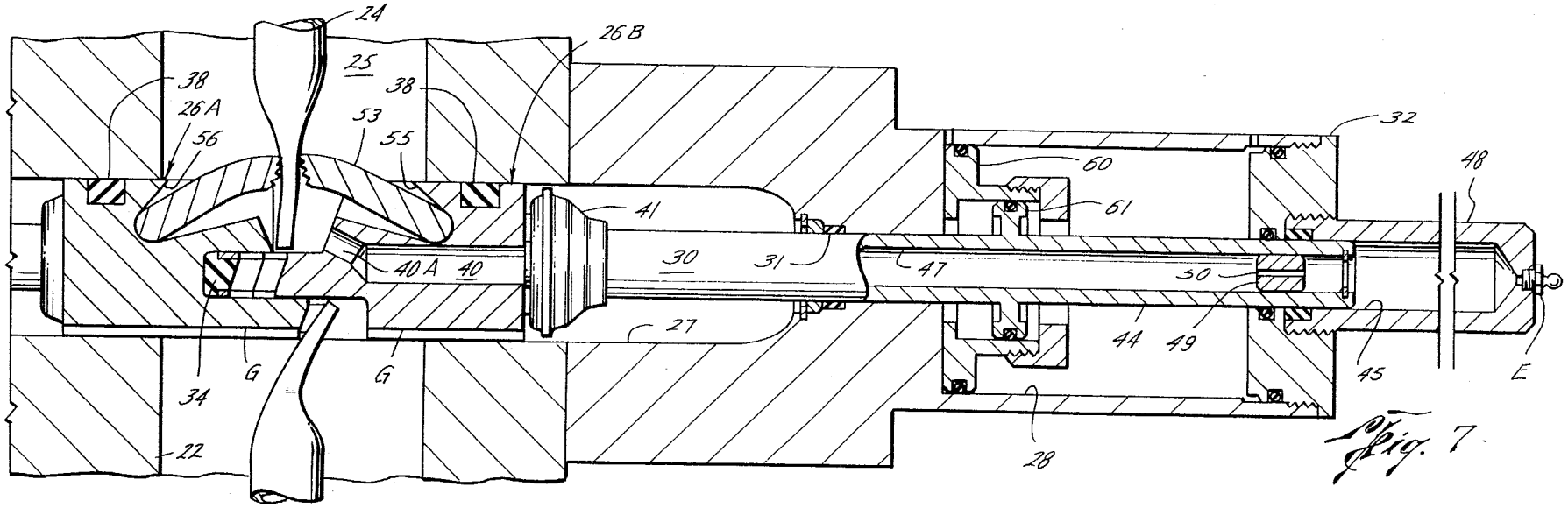
Figure 8:
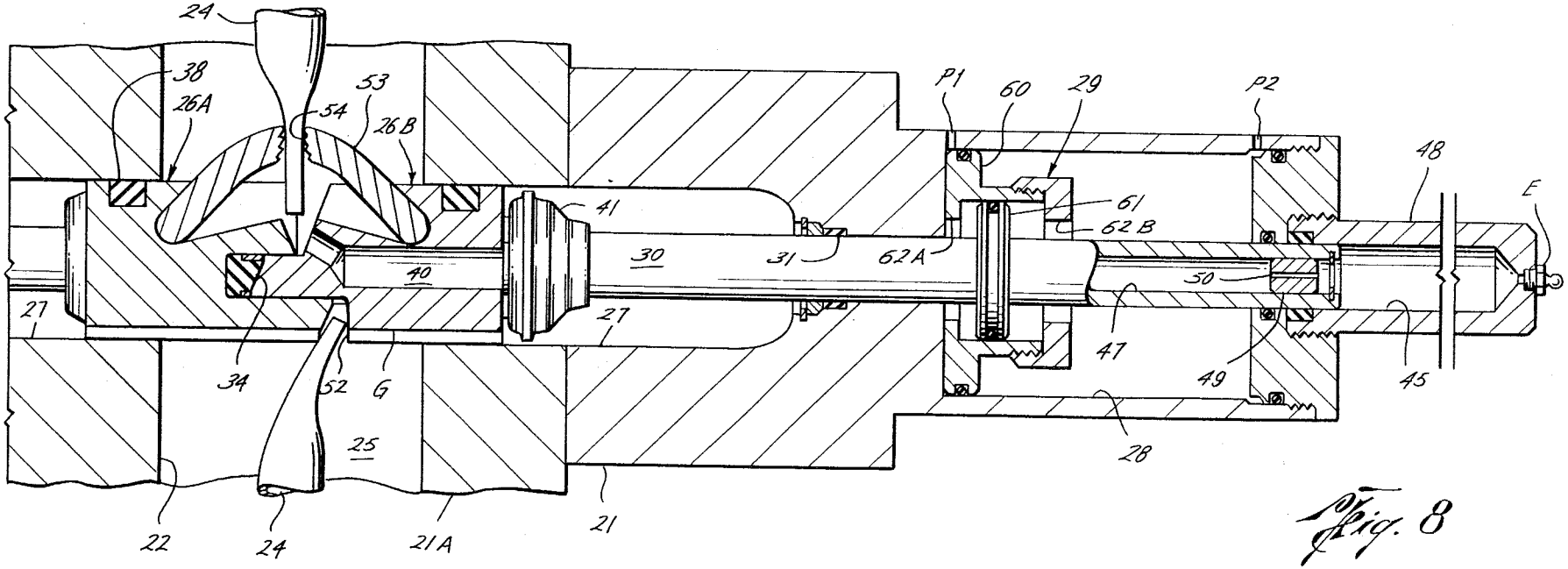
Figure 9:
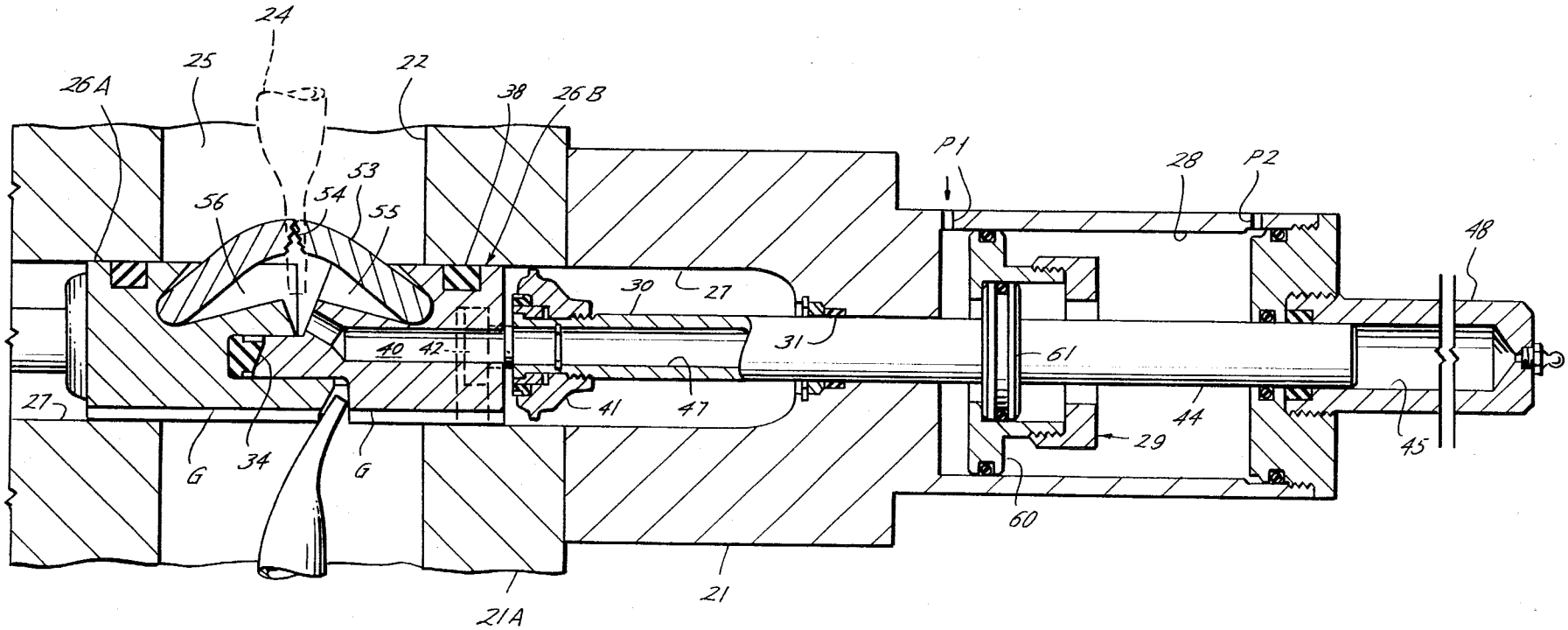

FIG. 7 is view similar to FIG. 6, but upon continued inward movement of the rams, following shearing of the pipe, to cause the arms to lift the upper sheared end of the pipe above the upper blade and thus out of the path between the inner end of the upper blade and the packing extending transversely across the inner end of the other ram above the lower blade, and showing movement of the inner piston of the operating system inwardly with respect to the stopped outer piston;

FIG. 8 is a view similar to FIG. 7, but upon still further inward movement of the rams in response to further inward movement of the inner piston in order to further lift the cut end of the pipe, above the inner ends of the rams, and move inner end of the upper blade into sealing engagement with the packing on the lower blade in order to close the bore through the housing; and FIG. 9 is a view similar to FIG. 8, but upon removal of the upper sheared end of the pipe from between the gripping and lifting arms to permit their inner ends to swing downwardly and inwardly into engagement with one another, and the supply of control fluid to the inner sides of the pistons of the operating system to withdraw the inner end of the rod of the right-hand piston to open the passageway therein and thereby equalize pressure across the inner and outer ends of both rams.

Figure 1:
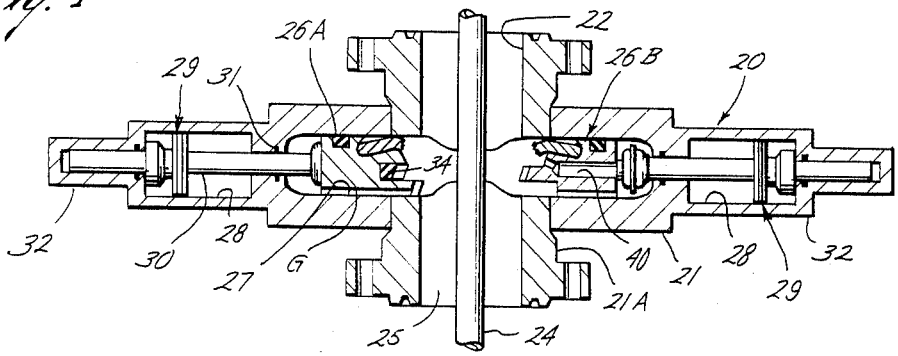
FIG. 1 is a vertical, sectional view of a blowout preventer constructed in accordance with the present invention, and with the rams thereof withdrawn to positions within their guideways.
Figure 2:
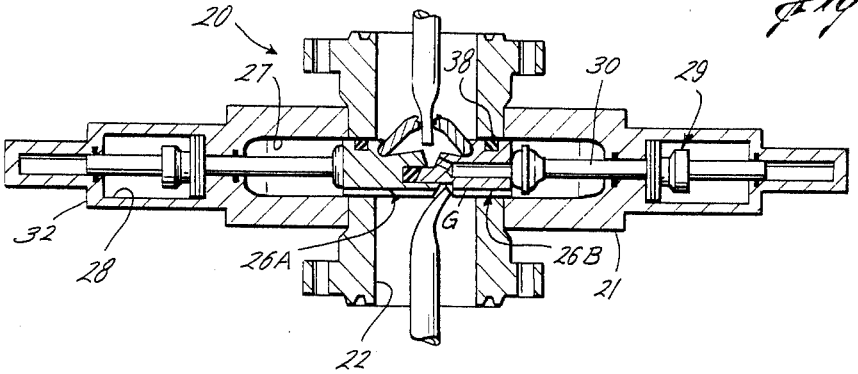
FIG. 2 is a vertical, sectional view of the preventer similar to FIG. 1, but upon inward movement of the rams to shear the pipe, lift the upper cut end thereof out of the path between the means on the ram faces for sealing between them, and then seal with respect to one another and with respect to their guideways.

With reference now to the details of the above-described drawings, the preventer shown in FIGS. 1 and 2, and indicated in its entirety by reference character 20, comprises a housing 21 having a vertical bore 22 therethrough and flanges on its upper and lower ends for connecting it as a part of a wellhead with its bore 22 in axial alignment with the bore of the wellhead. As shown, a pipe 24 extending vertically through the bore of the preventer may be part of a drill string suspended from a drilling rig and having a bit on its lower end adapted to extend to the bottom of the well bore. As well known in the art, in the drilling of the well, drilling mud would be circulated downwardly through the drill string and out the bit and then upwardly within the annulus 25 between the drill string and the bore.

The preventer includes a pair of rams 26A and 26B received within guideways 27 intersecting opposite sides of the bore 22 for movement between outer positions in which they are withdrawn from the bore, as shown in FIG. 1, during drilling of the well, and inner positions in which they are disposed across the bore to seal with respect to one another and the housing so as to close the bore, as shown in FIG. 2. Each ram is moved between opened and closed positions by means of an operating system including a cylinder 28 of the housing 21 outwardly of each ram guideway, piston means 29 reciprocable within each cylinder, and a rod 30 extending sealably through a packing or seal 31 within an opening through a wall of the housing separating a chamber behind the ram from the cylinder to connect the ram to the piston means. As will be described to follow, hydraulic fluid from an external source may be supplied to or exhausted from the cylinder on opposite sides of the piston means 29 in order to selectively move the pistons and thus the rams toward or away from the bore.

Each housing 21 comprises a main body 21A in which the bore 22 and the guideways 27 are formed, and a pair of bonnets 32 each connected across the outer end of a guideway 27 and forming a chamber to receive one of the open rams. Thus, each bonnet may be pivotally connected to one side of the main body, as shown and described in detail in my copending application, for movement between a closed position across the guideway, and an open position to one side of the guideway in order to permit the rams to be removed from the chamber in order to be replaced or repaired. Alternatively, and as well known in the art, the bonnets may instead be connected to a main body of the housing by an auxiliary fluid-operated system which enables the bonnets to be moved in axial directions toward or away from the opposite sides of the main body of the housing to permit replacement and repair of the rams.

Each ram comprises a metallic ram body 33 which is generally oval-shaped in cross section for sliding axially inwardly and outwardly toward and away from the bore within a chambers of the preventer housing, and blades BU and BL on the right and left rams 26B and 26A, respectively, having cutting edges for shearing pipe 24 as they move over one another. More particularly, the cutting edge of blade BU of the upper blade on right-hand ram 26B is adapted to move over the cutting edge BL of the lower blade of left-hand ram 26A, and a packing 34 is carried by ram 26A above blade BL in position to be sealably engaged by the inner end 35 of blade 26B, upon shearing of the pipe and lifting of the upper sheared end thereof (as will be described to follow) as the rams move further inwardly to closed positions.

In addition, each ram carries packing having inner face portions 36 at opposite sides of the laterally extending packing 34 (in the case of the left-hand ram) and the blade end surface 35 (in the case of the right-hand ram), as well as side portions 37 which extend rearwardly from each such face portion along each side of the ram body, and top portions 38 which connect with the outer ends of the side portions 37 and extend over the top of the ram. As can be seen from the drawings, and as well known in the art, the top portions 38 remain within the guideways as the rams move into their outer positions, whereby the rams packings form a continuous seal to close off the bore of the preventer housing.

The cutting edges of the lower and upper blades are of a shallow "V" shape to cooperate with one another to center the pipe as the cutting edges move toward and past one another in shearing the pipe. As the upper sheared end of the pipe is lifted out of the path between the packing 34 and surface 35 to permit the rams to sealably engage one another as they are moved into closed position, the lower end of the sheared pipe is adapted to move into a recess 52 formed in the lower side of the right-hand ram so that the pipe does not interfere with full closing movement of the rams.

As previously described, the means for gripping opposite sides of the pipe an the upper sheared end thereof comprises an arm 53 on each ram having its outer end pivotally mounted on the arm for swinging about a generally horizontal axis transverse to the axis of reciprocation of the ram. As the ram is moved inwardly to cause its inner end 54 to engage one side of the pipe, it is so supported in a recess 55 in the top side of the ram that its inner end is above its pivotal axis, so that as the ram continues to move inwardly to lift the pipe, the arm swings upwardly about its pivot axis. Thus, the predominately horizontal components of force due to the rams, as the pipe is gripped and crushed, become predominately vertical components as the cut end of the pipe is lifted. Preferably, an imaginary line extending through the inner end of each arm and its pivot axis extends at an angle of about 30° to the horizontal, in the supported positions of the rams, and about 60° thereto when the rams are closed.

Figure 5:
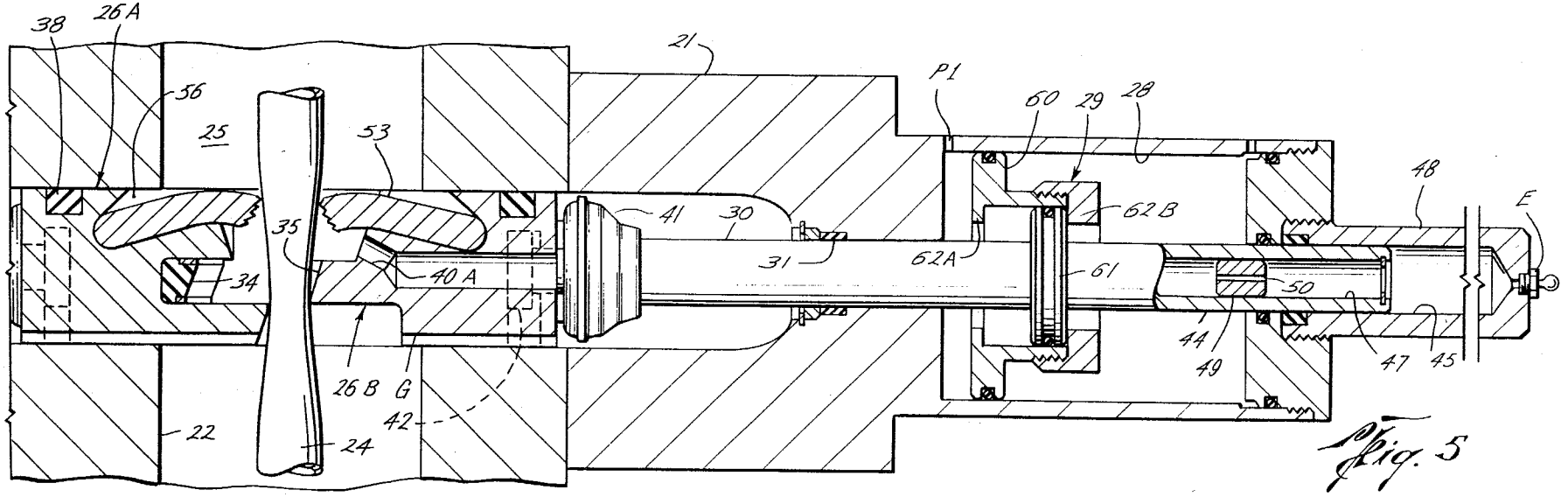
FIG. 5 is a view similar to FIG. 4, but upon inward movement of the rams in response to the application of control fluid to the outer sides of the pistons of the operating system to cause the inner ends of the cutting edges of the blades to engage and begin to flatten opposite sides of a pipe within the bore of the housing.

As shown, the inner end of each arm has a wide band of horizontal teeth to grip and flatten the sides of the pipe above the sides of the pipe flattened by the blades and then tightly hold the flattened sides therebetween so as to lift the pipe with the inner ends of the pipe as the arms swing. Thus, as shown in FIG. 5, inward movement of the blades with the rams will initially compress the pipe to some extent along the shearing plane as the inner ends of the arms first move into engagement with the pipe above the cutting edges of the blades. As the rams move further inwardly, the blades will continue to flatten the sides of the pipe as the arms above the blades begin to flatten them above the blades (see FIG. 5). When the blades have sheared the pipe, and the rams continue to move inwardly, as shown in FIG. 6, the arms will pivot upwardly as the teeth on their inner ends roll over the flattened sides of the pipe to lift the cut end above the upper blade (FIG. 7) and thus out of the path of movement between the surface 35 and the seal member 34.

As the upper sheared end of the pipe continues to be lifted a still further amount, the rams move into sealing engagement with one another, as shown in FIG. 8. At this time, the upper sheared end of the pipe is free to be lifted from the position shown in broken lines in FIG. 9 for removal with the drill string from within the bore of the preventer. This allows the inner ends of the arms to swing downwardly and inwardly into engagement with one another, as shown in FIG. 9. As the rams are then withdrawn to their open positions, the inner ends of the arms will continue to swing downwardly together into supported position and then separate to move outwardly with the rams into withdrawn position. As will be appreciated, if there is no pipe in the hole, the inner ends of the arms will engage one another as the rams move inwardly to a position somewhat intermediate that of FIGS. 6 and 7, and then swing upwardly together, upon continued inward movement of the rams, as the rams move into sealing engagement.

Figure 3:
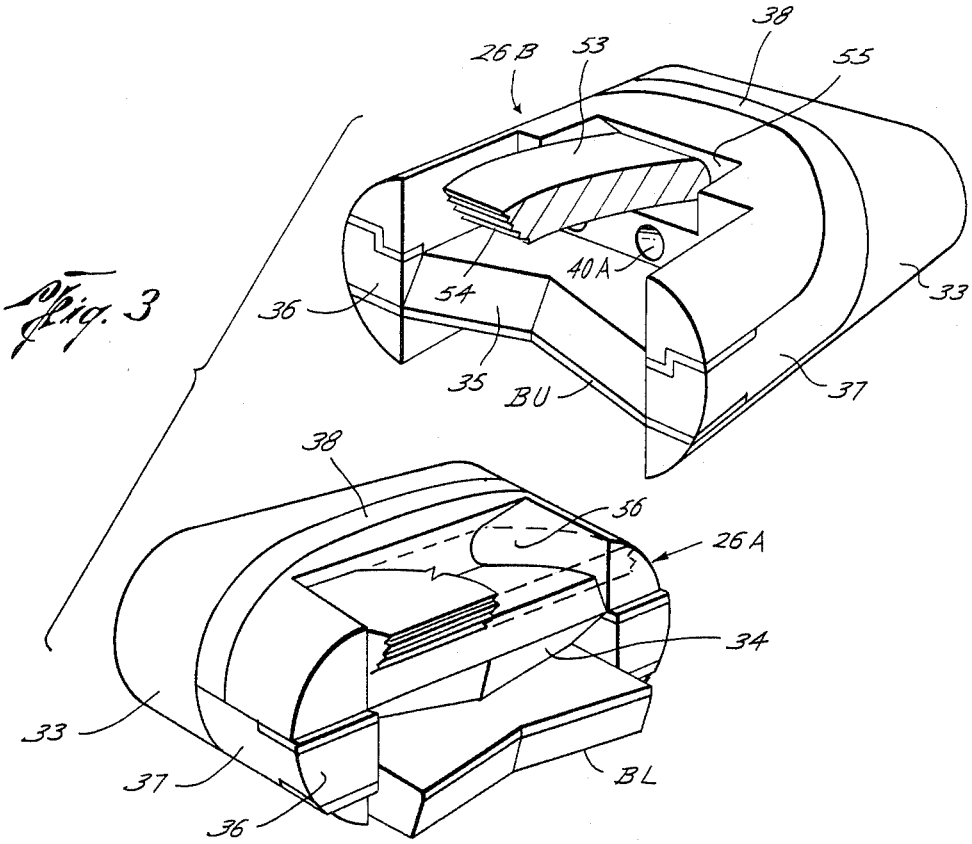
FIG. 3 shows both rams removed from their guideways, as seen from the inner end, one side, and the top thereof.

As best shown in FIG. 6, the inner ends of the arms extend forwardly through the open front ends of the recesses so that, in their supported positions, the inner ends are spaced from one another as the pipe is sheared. Preferably, the spacing approximates one and one-half times the double thickness of the wall of the pipe to be sheared. The energy stored in the pipe as it is crushed by the arms will, as the pipe is sheared, provide a force tending to cause the cut end of the pipe to jump up. As best shown in FIG. 3, recess 55 in the right ram 26B opens to a lower recess in the ram above blade BU, and, in the case of the left ram 26A, recess 56 is formed above a ledge of the ram body above seal member 34. The inner end of this ledge moves into the lower recess of the right ram 26B as the rams move to closed position (see FIG. 8).

The outer end of each arm is curved to fit closely within the curved outer end of each recess (see FIG. 3) to permit pivoting of the arm in the manner described. The top sides of the arms are substantially flush with the top sides of the ram bodies, so that the top sides of the guideways prevent the arms from swinging up out of supported positions until the arms emerge from the guideways and move into engagement with opposite sides of the pipe. If the arms do not swing downwardly as the rams are withdrawn from closed position, they will be engaged by the inner ends of the guideways to force them downwardly into supported position. Preferably, the recesses include top inclined walls which are adapted to limit pivotal movement of the lifting arms substantially beyond the positions shown in FIG. 8.

The piston means 29 of the operating system for each ram includes a first outer, annular piston 60 carrying a seal ring for sealably sliding within the cylinder 28 between innermost and outermost positions determined by engagement with the inner and outer ends of the cylinder 28, respectively, and an inner piston 61 which carries a seal ring for sealably sliding within the outer piston 60. The inner piston is fixed to the rod 30 for moving the ram inwardly and outwardly therewith, and the inner and outer pistons have means which permit only limited axial movement with respect to one another. Thus, the outer piston has a first flange 62A on its inner end which limits its outward movement with respect to the inner piston 61, and a flange 62B on its inner end which limits its inward movement with respect to the piston 61.

Figure 4:
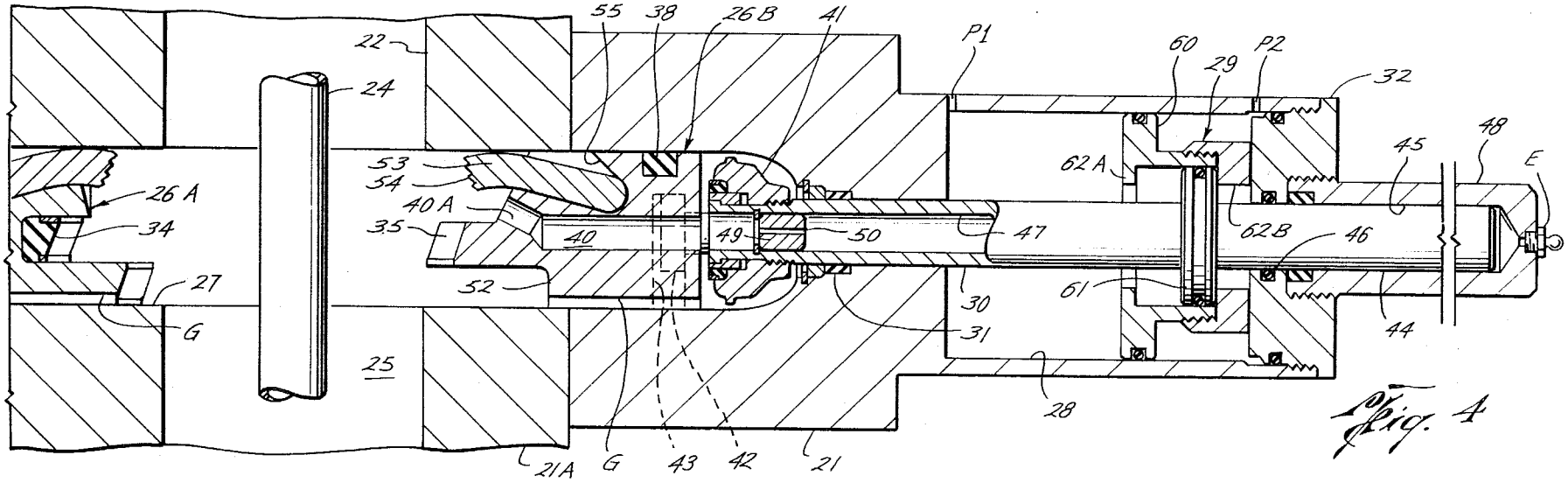
FIG. 4 is a vertical, sectional view of part of the preventer, including the right-hand ram and the operating system therefor, and with the pistons of the operating system moved outwardly to fully retracted positions in order to withdraw the rams to the open position.

As shown in FIG. 4, when operating fluid, has been supplied through the port $P_1$ to the inner sides of both pistons in order to open the rams, both pistons occupy their outermost positions—i.e., the outer piston 60 engages with the outer end of the cylinder, and the outer side of the piston 61 engages with the flange 62B of the outer piston. In order to move the rams inwardly to shear the pipe and close the bore of the preventer, operating fluid is supplied to the outer sides of the pistons through ports $P_2$ and exhausted from the inner sides thereof through ports $P_1$. During initial inward movement, the pistons will move with one another by virtue of the engagement of the flange 62B of piston 60 with the outer side of piston 61 until the arms engage and begin to flatten opposite sides of the pipe, as shown in FIG. 5, and the blades shear the pipe, as shown in FIG. 6. During this stage, the force due to the operating system which moves the rams is at its maximum since operating fluid is acting over the effective pressure-responsive areas of both pistons.

However, as the pipe is sheared, as shown in FIG. 6, the inner end of the outer piston 60 will move into engagement with the inner end of its cylinder 28 to stop its further inward movement. As a result, the rams will be moved further inwardly to lift the sheared end of the pipe, and seal with respect to one another and their guideways by a force due only to operating fluid acting over the inner piston 61. As a consequence, neither the pressure in the sealing means carried by the rams nor the force with which the rams are held in closed position by the operating fluid is excessive. As shown in FIG. 8, when the cut pipe has been lifted and the rams have been moved into sealing engagement, the inner end of the piston 60 is spaced somewhat from the flange 62A so that its engagement therewith will not interfere with full sealing engagement between the rams and some allowance is made for some wear of the face seals of the rams during continued use of the preventer.

When the rams are to be withdrawn to their open positions, operating fluid is instead introduced through ports $P_1$ into the cylinders on the inner sides of the pistons and exhausted through ports $P_2$ from the outer sides thereof. As a result, and as shown in FIG. 9, the outer pistons 60 will move outwardly with respect to the inner pistons 61 until flanges 62A engage the inner pistons, and then move the inner pistons and the control rods 30 with them. The rams will then continue to move outwardly until the outer ends of the pistons 60 engage the outer end of the cylinders, and the inner pistons move outwardly with respect thereto into engagement with flanges 62B.

As is common in the art, each ram body is provided with a groove G in its lower side which connects the bore 22 of the housing on its inner end with the chamber on the outer end of the ram, whereby, with the rams closed, well fluid pressure from the bore acts on the outer ends of the rams to hold them closed with a force in addition to that of the operating system. Thus, in the closed positions of the rams, well fluid pressure below the rams is ordinarily much higher than that above the rams, so that there is a relatively large pressure differential acting over the area of the rams circumscribed by the seal means thereon.

As in the preventer of my copending application, a passageway 40 is formed in the right-hand ram 26B to connect at its outer end with the ram chamber on the outer side of the ram and on its inner end with the upper inner portion of the ram circumscribed within the continuous seal means, and thus with the bore of the preventer housing above the rams when closed. Preferably, the inner end of the passageway 40 has diverging branches 40A which connect with the lower recess of the ram 26B below arm 53 and above blade BU, and thus with an open area between the inner ends of the closed rams (see FIG. 9). Also, for reasons described in my aforementioned copending application, the cross-sectional area of the passageway is greater than that of the groove G.

As was also true in the preventer of my prior application, the inner end of the control rod 30 for the right-hand ram 26B has an enlarged head 41 with studs 42 projecting from its inner end on opposite sides of an annular packing 43, which is coaxial with the passageway 40 to alternately sealably engage the outer end of the ram about the outer end of the passageway 40 to close the passageway or disengage therefrom to open the passageway. More particularly, the studs 42 are removably received within enlarged "T"-slots 43 in the right-hand ram on opposite sides of the passageway 40 to form a lost motion connection between the rod and ram so that the packing 43 is free to move forwardly to seal about the outer end of the passageway 40 as the operating system moves the ram inwardly, but to move out of engagement with the outer end of the ram to open the passageway 40, when the operating system is actuated to withdraw the right-hand ram. The lower ends of the "T"-slots extend through the lower ends of the right-hand ram to provide a means by which the ram may be installed upon or removed from the inner end of the control rod when the right-hand bonnet is moved to open position.

Thus, as in the case of both rams of the preventer of my prior application, actuation of the operating system to withdraw the right-hand ram automatically opens the passageway 40 therein to substantially equalize pressure across the inner and outer ends of the right-hand ram and thus permit it to be opened with less force. As previously described, however, although the left-hand ram 26A is of more or less conventional construction in that it has no such passageway therethrough, withdrawal of the inner end of the right ram from sealing engagement with the inner end of the left ram permits the pressure across the inner and outer ends of the left ram to also substantially equalize thereby also facilitating its withdrawal.

The rod 30 for the left-hand ram 26A as well as the means by which they are connected may be identical to the rod 30 for the ram 26B and their connection to one another. Alternatively, however, since the inner end of the rod does not function to open and close a passageway through ram 26A, studs on its inner end of the rod fit closely with "T" slots in the outer end of the ram. Thus, the connection permits the ram to be replaced or repaired, but prevents any significant relative axial movement between the rod and ram during the opening and closing cycle.

As was also true of the preventer of my prior application, another rod 44 extends outwardly from each piston 61 and sealably through a seal ring 46 carried within an opening in the outer end of the cylinder 28 and into outer chamber 45 within the bonnet. Thus, a tubular member 48 is threadedly connected to a counterbore in the outer end of the opening in the end of the cylinder to form the outer chamber 45, and additional packing is received within the inner end of member 48 for sealing between it and the rod 44 outwardly of ring 46.

More particularly, a hole 47 extends through the piston means and each of the inner rod 30 and outer rod 44, and the cross-sectional area of the inner and outer rods extending through the seal means 31 and 46 are essentially the same. Thus, in the case of right ram 26B, the rods are essentially pressure balanced, not only when the ram is withdrawn and head 41 is spaced from the outer end of ram 26B, during opening of the ram, but also during closing of ram 26B when hole 47 is connected to passageway 40. A similar hole may be formed through the piston and rods 30 and 44 for left ram 26A, so that with rod 30 connected to the left ram by a lost motion connection, as in the case of the rod 30 for ram 26B, it too would be pressure balanced during withdrawal of the ram. Also, of course, if desired for this purpose, the connection of the rod to the ram may be close fitting, and a port in rod 30 for ram 26A may connect the hole 47 therethrough with the chamber 45.

As also described in connection with my copending application, a fitting E carried by the housing bonnet, and more particularly by the outer end of the tubular member 48, so as to permit grease to be injected into the outer chamber 45 and at least part of the hole 47 connecting therewith in order to substantially exclude drilling mud from entry into the chamber 45 and thus protect the seal 46 about the outer end of the rod 44. A plug 49 of plastic or other suitable material is slidable within the hole 47 between inner and outer limited positions so as to normally separate the well fluid from the grease. The limits of movement of the plug are determined by snap rings held within the inner and outer ends of the inner rod 30 and outer rod 44.

When the rams have been moved to closed positions, the plugs 49 will have been moved outwardly to positions at least near their outer limited positions by virtue of the withdrawal of the major portions of the outer rods 44 from the chambers 45. In the event grease has been lost from chamber 45, the plug will be held within the hole by the outer snap ring, and a certain amount of drilling mud may bypass the plug through a restricted port 50 therein. As the rams are withdrawn, and the outer rods 44 move into the chambers 45, the plugs 49 will be forced inwardly toward its innermost position, as indicated in FIG. 4. Grease may bypass the plug through a restricted port 50 in the plug, which eliminates the need for the machining of slots in the hole through the rods, as disclosed in my prior application.

Reviewing now the overall operation of the preventer, and assuming that the rams are withdrawn to their outer positions, as shown in FIGS. 1 and 4, and there is a pipe 24 in the bore 22 to be sheared, control fluid is supplied to the outer sides of the piston means 29 while being exhausted from the inner sides thereof so as to cause the rams to move inwardly into engagement with opposite sides of the pipe. It will be understood in this regard that the rams do not necessarily move into these positions simultaneously, and in fact one ram will ordinarily precede the other into engagement with one side of the pipe. This of course is especially true when the control rod for only one of the rams is pressure balanced at this stage of the operating cycle, in which case of course that ram would ordinarily move inwardly prior to the other ram. In any event, engagement of the inner end of the one ram with one side of the pipe will delay its further inward movement until the other ram has moved inwardly to cause its inner end to engage the opposite side of the pipe.

As previously described, both rams are so moved with a relatively large force since well fluid acts over the outer ends of both the inner and outer pistons 60 and 61. As shown in FIG. 5, continued inward movement of the rams with this relatively large force will cause their inner ends to begin to flatten the sides of the pipe, and then continue to flatten them until the pipe is sheared by movement of the cutting edges of the rams past one another, as shown in FIG. 6. As will also be understood from FIG. 6, during this movement of the rams to shear the pipe, the inner ends of arms 53 engage the opposite sides of the pipe above the shear blades to flatten them as well.

Thus, as the rams continue to move inwardly following shearing of the pipe, the inner ends of the rams 53 which grip the flattened sides of the pipe will begin to pivot upwardly from their supported positions and thus lift the upper sheared end of the pipe above the inner end of the path between the inner end 35 of the right-hand ram blades and the transverse packing 34, as shown in FIG. 7. Upon shearing of the pipe, the inner end of outer piston 60 has moved into engagement with the inner end of cylinder 28, so that the rams continue to be moved inwardly with a relatively small force due to control fluid acting over the outer end of only the piston 61.

The rams continue to be moved inwardly into closed position to cause the inner end 35 of the blade of the right-hand ram to sealably engage the packing 34 with a relatively small force. At the same time, of course, the arms 53 are caused to tilt further upwardly to lift the upper sheared end of the pipe above the inner ends of the rams above their blades, while the lower sheared end of the pipe has been pushed over into the recess 52, thereby preventing any interference to full closing movement of the rams.

The upper cut end of the pipe may now be removed with the drill string to permit the drilling rig from which it is suspended to be moved from the well site, the inner ends of the arms then being free to swing inwardly into engagement with one another. At this time, control fluid may be introduced into the cylinders 28 on the left-hand sides of the piston means, while being exhausted from the right-hand sides thereof, in order to withdraw the rams into their outer positions. As shown in FIG. 9, each outer piston 60 will initially move outwardly relative to the inner piston until flange 62A engages the inner side of each inner piston, as a result of which the rams will be withdrawn initially with a relative large force due to the effect of control fluid over the inner ends of both pistons. Outward movement of rod 30 will of course open the outer end of passageway 40 in the right-hand ram 26B so as to vent the relatively high pressure within the chamber behind the ram 26B to the bore 22 above the closed rams. As previously explained, this not only substantially balances the pressure across both ends of the right-hand ram, but also, upon withdrawal of the right hand ram from the left ram, substantially balances pressure across the inner and outer ends of the left-hand ram 26A, thereby facilitating the withdrawal of each.

In the event there is no pipe 24 within the bore 22, and the rams are to function as conventional "blind" rams, the inner ends of arms 53 will engage one another upon inward movement of the rams to a position just beyond that shown in FIG. 6. At this stage of the closing movement of the rams, the cutting edges of the shear blades will have moved past one another to permit the inner ends of the arms to engage, and, upon continued inward movement of the control rod for each ram, to pivot upwardly into an inclined position. This inward movement and upward pivoting of the arms will continue until the inner end 35 of the blade of the right-hand ram engages the packing 34. At this point, the arms will be inclined to the extent illustrated in FIG. 9.

During the opening and closing cycles of the rams, whether to shear a pipe or close on an open bore, the rod for operating the right ram 26B is always balanced, and the rod for operating the left ram 26A will be pressure balanced during a opening movement. Furthermore, the plug 49 will function in the manner previously described so as to substantially preclude the entry of drilling mud into the balance chamber 45.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blowout preventer, comprising a housing having a bore therethrough and opposed guideways therein intersecting the bore, a ram movable within each guideway toward and away from one another, each ram having a cutting edge on its inner end for moving across the cutting edge of the ram in the other guideway in order to shear a pipe within the bore, as the rams move toward one another, and means for sealing between the rams above the cutting edges and between each ram and the guideway in order to close the bore, upon shearing of the pipe and continued movement of the rams toward one another, and means carried by the rams for gripping opposite sides of the pipe as the rams move toward one another to shear the pipe, and lifting the upper sheared end of the gripped pipe out of the path of the means for sealing between the rams, as the rams continue to move toward one another.

2. A blowout preventer of the character defined in claim 1, wherein the gripping and lifting means carried by each ram includes an arm mounted on the ram for pivoting about a generally horizontal axis transverse to the axis of reciprocation of the ram, and means supporting each arm in such a position that its inner end moves into gripping engagement with a side of the pipe above its pivot axis, whereby upon continued inward movement of the rams, said arms swing upwardly about said pivot axis to lift the sheared end of the pipe with progressively larger vertical components of force.

3. A blowout preventer of the character defined in claim 2 wherein, each ram has a recess in its upper side which is open on its front end and each arm of each ram is supported within the recess with its inner end extending through the open end thereof, the upper side of the guideway limiting movement of the top side of the arm out of the recess as the ram is moved to closed position and being engageable with the top side of the arm to insure its return into the recess as the ram returns to open position.

4. A blowout preventer of the character defined in claim 1, wherein an imaginary line extending through the pivot axis and the inner end of each arm forms an angle with respect to the horizontal which increases from about 30° in the supported position of the arm to about 60° when the pipe is lifted and the rams are closed.

5. A blowout preventer of the character defined in claim 1 wherein, in the absence of a pipe within the bore, the inner ends of the arms will engage one another and tilt upwardly to permit the inner ends of the rams to move into sealing engagement with one another.

6. A blowout preventer of the character defined in claim 1 wherein, said sealing means includes a packing strip on one ram above the lower cutting surface thereof for engagement by a surface on the inner end of of the other ram above the upper cutting surface thereof.

7. For use in a blowout preventer which includes a housing having a bore therethrough and guideways therein intersecting the bore; a ram assembly comprising a pair of rams each adapted to move within a guideway toward and away from the other ram moveable within the other guideway, a cutting edge on the inner end of each ram for moving across the cutting edge of the other ram in order to shear a pipe within the bore, as the rams move toward one another, and means on the rams for sealing between them above the cutting edges and between each of them and the guideway in which it moves in order to close the bore, upon shearing of the pipe and continued movement of the rams toward one another, and means carried by the rams for gripping opposite sides of the pipe as the rams move toward one another to shear the pipe, and lifting the upper sheared end of the pipe out of the path of the means for sealing between them, as the rams continue to move toward one another.

8. A ram assembly of the character defined in claim 7, wherein, the gripping and lifting means carried by each ram comprises an arm mounted on the ram for pivoting about a generally horizontal axis transverse to the axis of reciprocation of the ram, and means supporting each arm in such a position that its inner end moves into gripping engagement with a side of the pipe above its pivot axis, whereby upon continued inward movement of the rams, said arms swing upwardly about said pivot axis to lift the sheared end of the pipe with progressively larger vertical components of force.

9. A ram assembly of the character defined in claim 8, wherein, an imaginary line extending through the pivot axis and the inner end of each ram forms an angle with respect to the horizontal which increases from about 30° in the supported position of the arm to about 60° when the pipe is lifted and the rams are closed.

10. A ram assembly of the character defined in claim 8, wherein, in the absence of a pipe within the bore, the inner ends of the arms will engage one another and tilt upwardly to permit the inner ends of the rams to move into sealing engagement with one another.

11. A ram assembly of the character defined in claim 8 wherein, each ram has a recess in its upper side which is open on its front end and each arm of each ram is supported within the recess with its inner end extending through the open end thereof, the upper side of the guideway limiting movement of the top side of the arm out of the recess as the ram is moved to closed position and being engageable with the top side of the arm to insure its return into the recess as the ram returns to open position.

12. A ram assembly of the character defined in claim 8 wherein, said sealing means includes a packing strip on one ram above the lower cutting surface thereof for engagement by a surface on the inner end of of the other ram above the upper cutting surface thereof.

13. A blowout preventer ram, comprising a body movable within a guideway of a blowout preventer housing toward and away from a bore through the housing which is intersected by the guideway, a cutting edge on the inner end of the ram body for moving across a cutting edge of another ram movable within an opposed guideway, whereby a pipe within the bore will be sheared as the rams move toward one another, means on the inner end of the ram body above the cutting edge for sealing engagement with means on the inner end of the body of the other ram, above its cutting edge and along opposite sides and over the top side of the ram body for sealably engaging with the guideway, upon shearing of the pipe and continued movement of the rams, toward the other ram and means carried by the ram for gripping a side of the pipe opposite the side of the pipe gripped by gripping means carried by the other ram, as the rams move toward one another to shear pipe, and cooperating with said the gripping means carried by said other ram to lift the upper sheared end of the pipe out of the path of the sealing means on the inner ends of the ram bodies, as the rams continue to move toward one another.

14. A ram assembly of the character defined in claim 13 wherein the gripping and lifting means carried by the ram body comprises an arm mounted on the ram body for pivoting about a generally horizontal axis transverse to the axis of reciprocation of the ram, and means supporting the arm in such a position that its inner ends move into gripping engagement with a side of the pipe above the pivot axis thereof, whereby upon continued inward movement of the ram, said arm tilts upwardly about said axis to lift the sheared end of the pipe with progressively larger vertical components of force.

15. A ram assembly of the character defined in claim 14 wherein, an imaginary line extending through the pivot axis and the inner end of each arm forms an angle with respect to the horizontal which increases from about 30° in the supported position of the arm to about 60° when the pipe is lifted and the rams are closed.

16. A ram assembly of the character defined in claim 14 wherein, the ram body has a recess in its upper side which is open on its front end and the arm is supported within the recess with its inner end extending through the open end thereof, the upper side of the guideway limiting movement of the top side of the arm out of the recess as the ram is moved to closed position and being engageable with the top side of the arm to ensure its return into the recess as the ram returns to open position.

17. A ram assembly of the character defined in claim 13, wherein the means on the inner end of the ram body is a transverse packing element.

18. A ram assembly of the character defined in claim 13, wherein the means on the inner end of the ram body is a surface engageable with a transverse packing element on the other ram body.

19. A blowout preventer, comprising a housing having a bore therethrough and guideways therein intersecting the bore, a ram movable in each guideway toward and away from the other ram, each ram having a cutting edge on its inner end which cooperates with a cutting edge on the other ram to shear a pipe within the bore, as the rams move toward one another, and means for sealing with the other ram and with the guideway to close the bore, upon shearing of the pipe and continued movement of the rams toward one another, and fluid-operated means for moving the rams inwardly with a first force until the pipe has been sheared and then continuing to move the rams inwardly with a second, smaller force in order to close the bore.

20. A preventer of the character defined in claim 19, including means on the rams for lifting the upper sheared end of the pipe above sealing means on the inner ends of the rams in reponse to inward movement of the rams with said second force.

21. A blowout preventer, comprising a housing having a bore therethrough and guideways therein intersecting the bore, a ram movable in each guideway toward and away from the other ram, each ram having a cutting edge on its inner end which cooperates with a cutting edge on the other ram to shear a pipe within the bore, as the rams move toward one another, and means for sealing with the other ram and with the guideway to close off the bore, upon shearing of the pipe and continued movement of the rams toward one another, a pair of cylinders, first and second pistons sealably reciprocable within each of the cylinders, means for moving each piston toward or away from the housing bore, including means for supplying control fluid to one side thereof while exhausting control fluid from the opposite side thereof to urge it toward the housing bore, a rod connecting one of the pistons within each cylinder to each ram for moving it inwardly and outwardly therewith, means connecting the other piston within each cylinder to the one piston therein for limited inward and outward movement with respect thereto, whereby said other piston moves inwardly to engage the one piston, in response to the supply of control fluid to their outer sides, in order to move the ram inwardly to first shear the pipe with a force due to such fluid acting over both pistons, and means within each cylinder for stopping inward movement of the other piston when the rams have been moved inwardly to shear the pipe, whereby each ram continues to move inwardly into sealing position by a second smaller force due to control fluid acting over the one side of only said one piston.

22. A blowout preventer of the character defined in claim 21, wherein each first piston is sealable slidable within the cylinder, and each second piston is sealable slidable within the first piston.

23. A blowout preventer of the character defined in claim 22, wherein the first piston is the other piston, and the second piston is the one piston.

24. A blowout preventer of the character defined in claim 21, including means on the rams for lifting the upper sheared end of the pipe above sealing means on the inner ends of the rams in response to inward movement of the rams with said second force.

* * * * *